US008893328B1

(12) United States Patent
Kroeger

(10) Patent No.: US 8,893,328 B1
(45) Date of Patent: Nov. 25, 2014

(54) SLEEPING BAG FOR USE WITH HAMMOCK

(71) Applicant: Herrick C. Kroeger, Cave Springs, GA (US)

(72) Inventor: Herrick C. Kroeger, Cave Springs, GA (US)

( * ) Notice: Subject to any disclaimer, the term of this patent is extended or adjusted under 35 U.S.C. 154(b) by 87 days.

(21) Appl. No.: 13/677,606

(22) Filed: Nov. 15, 2012

Related U.S. Application Data

(60) Provisional application No. 61/560,712, filed on Nov. 16, 2011.

(51) Int. Cl.
*A45F 4/08* (2006.01)
*A47G 9/08* (2006.01)
*A45F 3/22* (2006.01)

(52) U.S. Cl.
CPC .. *A45F 3/22* (2013.01); *A47G 9/086* (2013.01)
USPC ..... 5/413 R; 5/120; 5/121; 5/122

(58) Field of Classification Search
USPC ..... 5/98.1, 98.3, 120–130, 413, 417–420
See application file for complete search history.

(56) References Cited

U.S. PATENT DOCUMENTS 1,071,764 A * 9/1913 Lowrimore ..... 5/122
2,321,966 A * 6/1943 Andersson ..... 5/122
2,971,205 A * 2/1961 Lowell ..... 5/413 R
3,675,256 A * 7/1972 Tallarico et al. ..... 5/120
3,964,113 A * 6/1976 Dean, II ..... 5/121
4,001,902 A * 1/1977 Hall et al. ..... 5/121
4,125,909 A * 11/1978 Jacobson ..... 5/121
5,072,465 A * 12/1991 Lyons, Jr. ..... 5/121
5,533,216 A * 7/1996 Thier ..... 5/413 R
5,560,056 A * 10/1996 Tai ..... 5/120
6,948,206 B1 * 9/2005 Valencia ..... 5/732
7,178,182 B2 * 2/2007 Brenner et al. ..... 5/413 R

OTHER PUBLICATIONS

The GearCaster, The Hammock Compatible Sleeping Bag, Mar. 13, 2012, pp. 1-2.*

* cited by examiner

*Primary Examiner* — William Kelleher
*Assistant Examiner* — David R Hare
(74) *Attorney, Agent, or Firm* — Lee & Hayes, PLLC; Charles L. Warner

(57) ABSTRACT

A sleeping bag (10) has a top layer (25) containing insulation and a bottom layer (30) containing insulation. An opening on the head end (15) and an opening on the foot end (20) are wide enough to accommodate a hammock (50). Preferably, these ends and/or the areas around the openings are reinforced. Flaps (310) reduce cold air entering via the openings. Tabs (45A-45D) stabilize the sleeping bag so that it does not slide along the hammock. The hammock is routed through the sleeping bag and connected so that the sleeping bag is suspended. The insulation on the bottom layer is below the hammock and so is not compressed by the weight of the user. This helps to preserve the insulating qualities of the sleeping bag, even when used with a hammock. The hammock rings are connected to available support objects, such as trees or posts.

18 Claims, 4 Drawing Sheets

SLEEPING BAG FOR USE WITH HAMMOCK

CROSS-REFERENCE TO RELATED APPLICATION

This application claims the priority of U.S. Provisional Patent Application Ser. No. 61/560,712, filed Nov. 16, 2011, and entitled "A Zippered Pass-Through System For Use On Sleeping Bags To Be Used With Hammocks", which is incorporated herein by reference in its entirety.

BACKGROUND

Camping equipment, including a sleeping bag, should be light and compressible because a hiker who is also camping may have to carry the equipment a long distance. It will be appreciated that a sleeping bag does not provide heat, but merely serves to trap and retain the user's own body heat, so a sleeping bag must provide sufficient insulation to keep the user warm. The insulation in a sleeping bag is most effective when the loft (thickness, or height) is at its design maximum.

When a sleeping bag is used in a hammock the weight of the user compresses the insulation, thereby decreasing the loft and the insulating value of the bag, particularly at pressure points along contact with a support system, which is often either the ground or a hammock. Even at temperatures where the sleeping bag should have sufficient insulation to keep the user comfortable, the user often feels cold when using a conventional sleeping bag because the insulation between the user and the support system has been compressed. This reduction in the insulating value is especially noticeable when the underside of the sleeping bag may be exposed to wind, such as when the sleeping bag is used with a hammock. Thus, the compressed insulation represents dead weight for the user as it does not provide the desired warmth. As a result, if a sleeping bag is to be used with a hammock, the sleeping bag must have more insulation so that the resulting insulation value is still adequate when the insulation becomes compressed. This, however, results in a larger and heavier sleeping bag, which is not desirable when backpacking

SUMMARY

A sleeping bag has a top layer containing insulation and a bottom layer containing insulation, and the top layer and the bottom layer are at least partially attached to each other, the user sleeping area being between the top layer and the bottom layer. The sleeping bag also has a first opening at a head end and a second opening at a foot end, the insulation of the bottom layer being below the first and second openings, and the first and second openings are sufficiently wide to accommodate at least part of a hammock. There is also a flap on the head end to at least partially block the first opening and a flap on the foot end to at least partially block the second opening to minimize air entering the user sleeping area through the openings. The sleeping bag also has tabs attached near the head end and the foot end to secure the sleeping bag to the hammock so that the sleeping bag does not slide along the hammock. The ends and/or areas around the openings are preferably reinforced.

An elevated sleeping system includes a sleeping bag and a hammock. The sleeping bag has a top layer, a bottom layer, a first opening at a head end, a second opening at a foot end, and tabs attached near the head end and the foot end. The top layer and the bottom layer are at least partially attached to each other. The sleeping bag also has a flap on the head end to at least partially block the first opening and a flap on the foot end to at least partially block the second opening. The tabs secure the sleeping bag to the hammock so that the sleeping bag does not slide along the hammock. The hammock has a bed and a pair of rings or loops on opposite ends of the bed, the bed being at least partially inside the sleeping bag. The hammock is inside the sleeping bag and extends at least partially from the first opening and at least partially from the second opening so that the rings or loops can be attached to supports. The ends and/or areas around the openings are preferably reinforced.

An article of manufacture includes a sleeping bag and a hammock. The sleeping bag has a top layer containing insulation, a bottom layer containing insulation, a fastener to reversibly fasten at least a part of the top layer to at least a part of the bottom layer, a flap to at least partially cover the fastener, a first opening at a head end and a second opening at a foot end. The sleeping bag also has a flap on the head end to at least partially cover the first opening, a flap on the foot end to at least partially cover the second opening, at least two chord loops attached to areas on or near the head end, and at least two chord loops attached to areas on or near the foot end. The areas where the chord loops are attached are reinforced. The hammock includes a bed and a pair of support rings or loops on opposite ends of the bed. The bed is at least partially within the sleeping bag, and at least part of the hammock extends from the first opening and at least part of the hammock extends from the second opening so that the hammock can be attached to supports. The first opening and the second opening are sufficiently wide to accommodate at least part of the hammock. The ends and/or areas around the openings are preferably reinforced.

DETAILED DESCRIPTION

Figure 1:
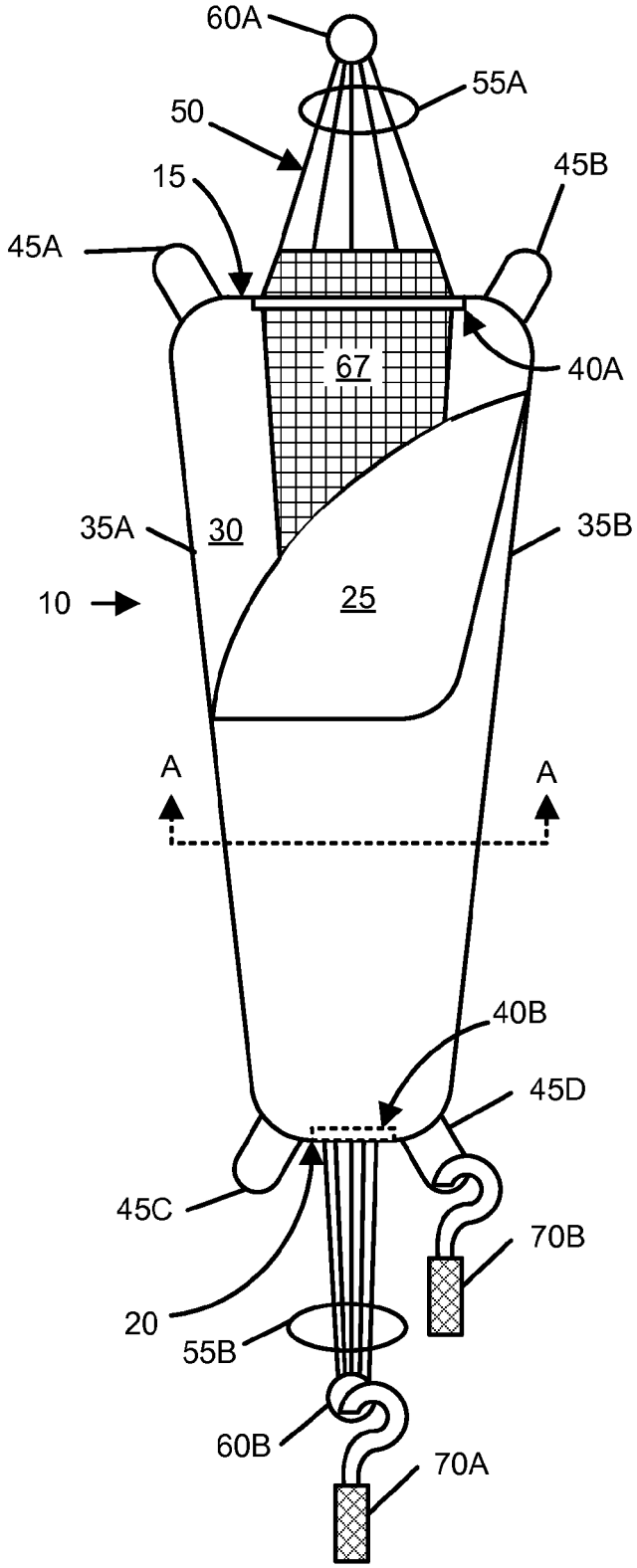
FIG. 1 illustrates an exemplary triangular or "mummy" sleeping bag for use with a hammock.

The following detailed description is directed to concepts and technologies for a sleeping bag which is particularly suited for use with a hammock. In the following detailed description, references are made to the accompanying drawings that form a part hereof, and in which are shown by way of illustration specific embodiments or examples. Referring now to the drawing, in which like numerals represent like elements throughout the several figures, aspects of an improved sleeping bag, and a sleeping bag particularly suited for use with a hammock, are presented herein.

Figure 2:
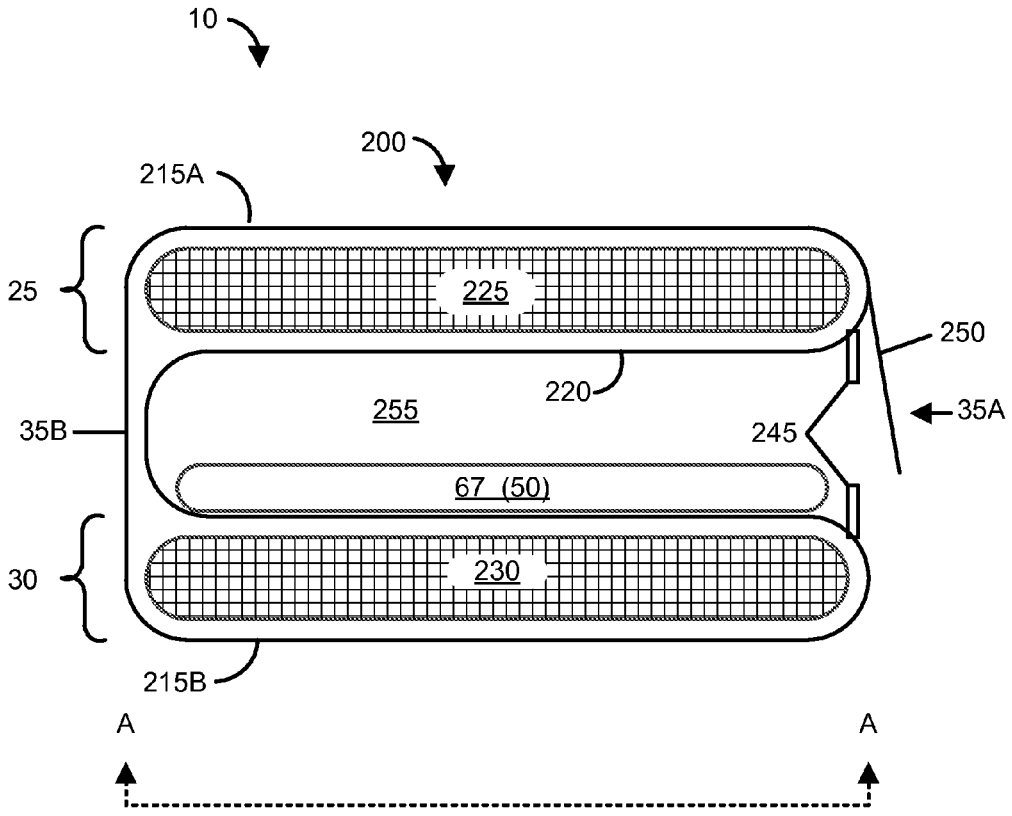
FIG. 2 is an illustration of a cutaway view of an exemplary sleeping bag along line AA.

FIG. 1 illustrates an exemplary triangular or "mummy" sleeping bag 10 for use with a hammock 50. The sleeping bag 10 preferably has a head end 15, a foot end 20, and a flexible top (or "upper") layer 25, shown partially folded back to show a flexible bottom (or "lower") layer 30. As discussed below, the volume between layers 25 and 30 is a sleeping chamber or area 255 (FIG. 2). For convenient ingress and egress, at least one side 35A of the top layer is reversibly fastened to at least one side of the bottom layer. If desired, both sides 35A, 35B of the top and bottom layers, or even all sides of the top and bottom layers, can be reversibly fastened together. This allows the top layer 25 and the bottom layer 30 to be partially or completely separated, and then rejoined.

There is a zippered, reinforced opening 40A at the head end 15 and another zippered, reinforced opening 40B at the foot end 20 of the sleeping bag 10. When the sleeping bag 10 is not being used with a hammock 50 then the zippered openings 40 are preferably kept closed. This prevents leaves, twigs, insects, etc. from entering the sleeping chamber. When the sleeping bag 10 is being used with a hammock 50 then the openings 40 are unzipped so that the hammock 50 can extend through the sleeping chamber 255 of the sleeping bag 10 and the ends of the hammock 50 can extend out of the sleeping bag 10 through the openings 40. The bed 67 of the hammock 50 is at least partially inside the sleeping bag 10, between the top layer 25 and the bottom layer 30, and at least part of the hammock 50, such as bed 67 or chords 55, extends out of the openings 40. A hammock 50 typically comprises at least support rings or loops 60A and 60B, support lines or chords 55A and 55B, and a bed 67. The hammock 50 may also have other components, such as, but not limited to, a stabilizer or spreading bar (not shown).

Chord loops, also referred to as tabs or "ears", 45A-45D are attached to the sleeping bag 10, preferably at or near the corners of the head end 15 and the foot end 20 of the sleeping bag 10. The tabs may be attached to the top layer 25 or the bottom layer 30, or some tabs may be attached to one layer and other tabs attached to the other layer. The tabs are preferably attached at or above the openings 40 so that the tabs do not transfer tension to the bottom layer 30 as such tension could cause compression of the insulation. The tabs 45 serve to stabilize the sleeping bag 10 to prevent it from sliding along the hammock 50. Thus, a cord, such as but not limited to a bungee cord 70B, is attached to a tab, such as tab 45D, routed through the ring or loop 60B, and attached to the other tab 45C. Similarly, at the head end 15, a cord (not shown) would be attached to a tab, such as tab 45A, routed through the ring or loop 60A, and the attached to the other tab 45B. The ends 15, 20 of the sleeping bag 10A are preferably reinforced to withstand the forces applied to the tabs 45 when the user is in the sleeping bag.

In use, the rings 60 are attached to suitable, available supports (not shown), such as but not limited to trees and posts, by a convenient mechanism, such as but not limited to exemplary cord or rope 70A which may be, for example, a bungee cord. For convenience and clarity of illustration, only two cords are shown, cord 70A attached to ring 60B, and cord 70B attached to tab 45D. It will be appreciated, however, as discussed above, that other cords, not shown, will be attached to the other ring 60A and the other tabs 45.

FIG. 2 is an illustration of a cutaway view 200 of an exemplary sleeping bag 10 along line AA. There is a sleeping chamber 255 between the top layer 25 and the bottom layer 30 for the user (not shown), the sleeping area or chamber 255 being defined by an inner skin or liner 220 and a fastener 245. At least the upper part of the liner 220 is preferably of a material which is smooth so as to be pleasant to the skin of the user and which does not tend to bind to the clothing of the user. The top layer 25 and the bottom layer 30 are preferably reversibly fastened along at least one side or edge, such as but not limited to side or edge 35A, for convenience of ingress and egress, by a fastener or fasteners. A fastener may be, for example, but not limited to, a zipper 245 and/or Velcro™. Preferably, but not necessarily, a protective flap 250 overlays the zipper 245 when the bag 10 is closed so as to prevent cold air from entering the sleeping chamber 255 via the zipper 245. The top layer 25 and the bottom layer 30 may be permanently joined along other edges, such as but not limited to side 35B, such as by making the skin 215A, 215B continuous, or may be joined by a fastener or fasteners. The outer skin 215A, 215B is water resistant; the lower outer skin 215B is preferably made of a more durable and waterproof material for occasions when the sleeping bag 10 is used on the ground rather than with the hammock 50.

The top layer 25 and the bottom layer 30 each include an insulator, such as but not limited to insulating blankets 225 and 230, respectively. The insulating blankets 225, 230 may be in separate enclosures (not shown) or may simply be enclosed by the various inner and outer skins 215, 220. As is well known, quilting or another form of stitching may be used to hold the insulation in place and prevent it from bunching into clumps or settling.

As mentioned, the hammock 50 is in, and extends out of, the sleeping chamber 255. When the user is in the sleeping bag 10, the weight of the user is borne by the bed 67 of the hammock 50; the insulating blanket 230 is on the underside of the bed 67 of the hammock 50, does not bear the weight of the user, and therefore is not compressed. As a result, the loft and the insulating qualities of the insulating blanket 230 are maintained.

Figure 3A:
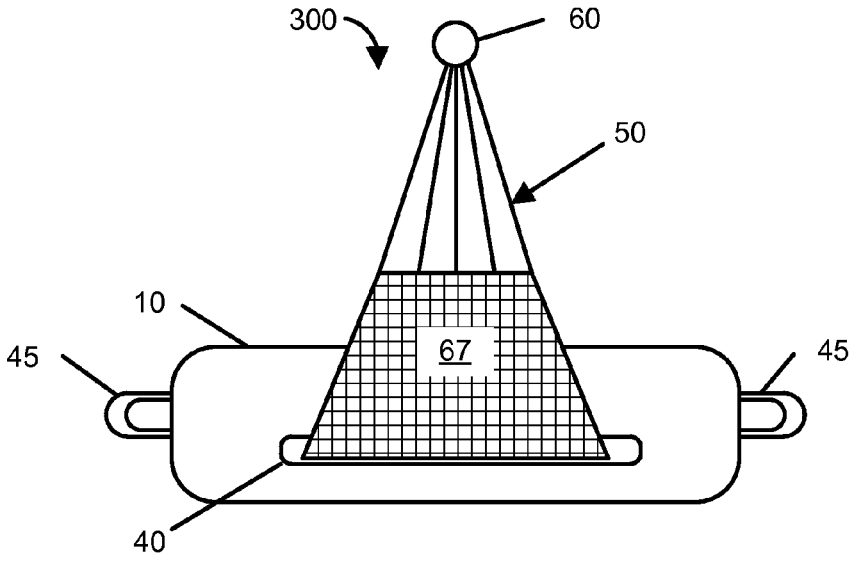
FIG. 3A illustrates an end view of an exemplary sleeping bag.
Figure 3B:
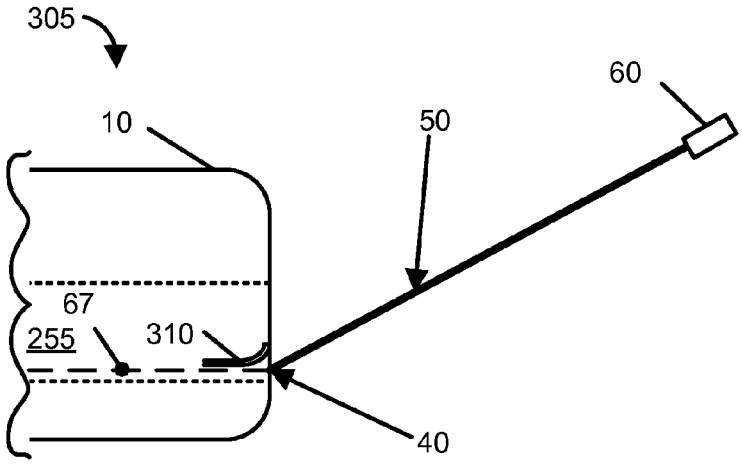
FIG. 3B illustrates a side view of the end of an exemplary sleeping bag.

FIG. 3A illustrates an end view 300 of an exemplary sleeping bag 10 along with a hammock 50. FIG. 3B illustrates a side view 305 of the end of an exemplary sleeping bag 10 along with a hammock 50. Two of the loops 45 are also shown. It will be appreciated that the user will not be able to obtain the full benefit of the loft being maintained for insulating blanket 230 if cold air enters the sleeping chamber 255 of FIG. 2 via an opening or entrance 40. Therefore, associated with each opening 40 is a flap 310 which preferably can substantially block or close the hole 40 when the hammock 50 is in use. A flap 310 may be large enough, for example, that it can be wrapped around the hammock 50 so as to minimize air leakage into the sleeping chamber 255. Preferably, but not necessarily, a flap 310 is stitched to the sleeping bag 50 just inside the opening 40. If desired, however, a flap 310 may be secured to the sleeping bag 10 by a zipper or other fastener so that it can be removed and cleaned or replaced.

Figure 4:
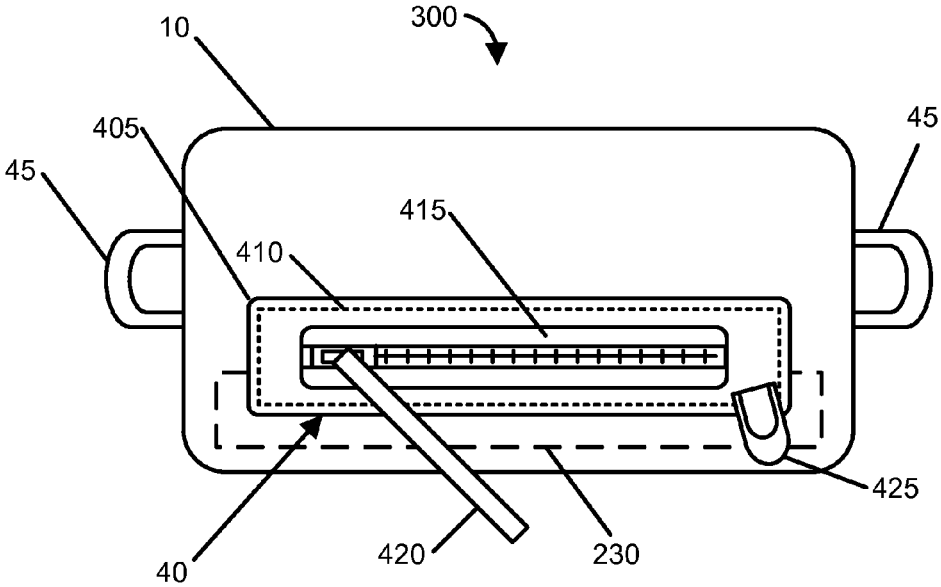
FIG. 4 illustrates an exemplary zippered opening at an end of the exemplary sleeping bag.

FIG. 4 illustrates an exemplary zippered opening 40 at an end 300 of an exemplary sleeping bag 10. The area 405 around the opening 40 is preferably a heavy duty fabric which reinforces at least the openings 40A and 40B, and may extend completely across the ends 15, 20 of the sleeping bag 10. The fabric may be any material appropriate for this purpose including, but not limited to, nylon, canvas, polypropylene, etc. The fabric may be secured to the sleeping bag 10 by stitches 410 or any other appropriate technique. Alternatively, the head end and foot end of the sleeping bag 10 may be made of such a heavy duty fabric. A zipper mechanism 415 and a pull tab 420 are also shown. When a hammock 50 is not being used, the opening 40 is preferably zippered shut. When a hammock 50 is being used, the zippers 415 are unzipped to open the openings 40 so that the ends of the hammock 50 can extend from them, and the flaps 310 are stuffed or wrapped around the hammock 50 at the openings 40. Chords 70B are attached to tabs 45 as described below. If desired, one or more accessory tabs 425 may be added, preferably to reinforced areas around the openings 40 or at the ends 15, 20 to support accessories such as, for example, a water bottle, a flashlight, a watch, etc., so that they will be conveniently accessible by the user.

The hammock being inside the sleeping chamber 255 also provides other benefits, such as but not limited to stability, and ease of ingress and egress. For example, if one merely lays a sleeping bag on a hammock then, as discussed above, the loft, and therefore the insulating qualities, of the insulation in the sleeping bag will be reduced due to the weight of the user once the user gets into the sleeping bag. In addition, consider the difficulty of even getting into the sleeping bag. The user can put the sleeping bag into a hammock, unzip the sleeping bag on one side, sit on the sleeping bag, and then try to get his or her feet up and into the sleeping bag, possibly while trying to kick off his or her shoes at the same time, get into the desired position in the sleeping bag, and zip the sleeping bag, all without the sleeping bag sliding off or along the hammock or the hammock turning over with the user and the sleeping bag. Or, the user can stand the sleeping bag upright, unzip the sleeping bag on at least one side, kick off his or her shoes, get into the sleeping bag, sit on the hammock (while in the sleeping bag) and swing his or her feet (at the bottom of the sleeping bag) up and into the hammock, get into the desired position in the sleeping bag, and zip the sleeping bag, again without the sleeping bag sliding off or along the hammock, or the hammock turning over with the user and the sleeping bag. Keep in mind, as well, that the hammock is not a stationary platform and often tends to move away from the user as the user is trying to get into it. The user must then reverse this process to get out of the sleeping bag.

Instead, using the sleeping bag 10 described herein, the user inserts the hammock 50 through the sleeping chamber 255. The user then attaches the hammock 50 to supports, such as but not limited to convenient trees, using the rings 60A, 60B, and, for example, a rope 70A. Either before or after attaching the hammock 50 to a support, the user inserts a chord 70B through the rings 60 and attaches the chord 70B to the tabs 45. The tabs 45 serve to stabilize the sleeping bag 10 so that it does not slide along the hammock 50. Now, to get into the sleeping bag 50, the user unzips one side (or both sides if desired) of the sleeping bag, turns down the top layer 25, sits on the hammock 50 which is inside the sleeping chamber 255 of the sleeping bag 50, kicks off his or her shoes, gets into the sleeping bag, easily swings his or her feet into position in the sleeping bag 10, gets into the desired position in the sleeping bag, and zips the sleeping bag, all without fear of turning over, or the frustration of the bag sliding along the hammock, because the sleeping bag and the hammock act as a unit. Also, the user does not have to worry about falling out of the hammock if the user changes his or her sleep position during the night. Getting out of the sleeping bag in the morning is similarly more convenient because the sleeping bag 10 and the hammock 50 again act as a unit. Therefore, the loft of the insulating blanket 230 is maintained because the weight of the user is on the bed 67 of the hammock 50, not on the blanket 230, the flaps 310 serve to keep cold air out of the sleeping chamber 255, and the tabs 45 serve to stabilize the hammock 50 on the sleeping bag 10 so that they act as a unit.

With the sleeping bag 10 described herein, the user can fully encapsulate himself or herself in the sleeping bag while still being supported by the hammock. The sleeping bag 10 functions to keep the user warm and comfortable while the hammock 50 performs the function of elevating and supporting the user. As the loft of the insulation is not diminished, the insulating value of the sleeping bag is maintained, even when used with a hammock. This results in a smaller and lighter sleeping bag, which is most desirable when backpacking.

Preferably, the sleeping bag 10 is made available in a variety of insulated profiles, for example, above freezing, below freezing, below zero degrees, etc. Those with ordinary skill in the art will know what type of insulation, and how much insulation, to use to provide the desired warmth for a particular environment. The improvement described herein can also be used with other sleeping bag designs such as, but not limited to, a rectangular sleeping bag (not shown). If desired, such as for use in warmer climates, the sleeping bag 10 may have little or no insulation. In such a case the sleeping bad 10 would primarily provide a water-resistant, above-ground bed for the user.

The subject matter described above is provided by way of illustration only and should not be construed as limiting. Various modifications and changes may be made to the subject matter described herein without following the exemplary embodiments and applications illustrated and described herein.

Although the subject matter presented herein has been described in language specific to the structural features of sleeping bags and hammocks, it is to be understood that the appended claims are not necessarily limited to the specific designs, placements, materials, or combinations thereof described herein. Rather, the specific designs, placements, materials, or combinations thereof are disclosed as example forms of implementing the claims.

The invention claimed is:

1. A sleeping bag, comprising:

a top layer containing insulation;

a bottom layer containing insulation, the top layer and the bottom layer being at least partially attached to each other;

the sleeping bag having a first opening on a head end and a second opening on a foot end, the insulation of the bottom layer being below the first and second openings, the insulation of the top layer being above the first and second openings, the first and second openings being in the bottom layer and having sufficient width to accommodate at least part of a hammock;

a flexible flap inside the sleeping bag on the head end to at least partially block the first opening;

a flexible flap inside the sleeping bag on the foot end to at least partially block the second opening; and tabs attached near the head end and the foot end.

2. The sleeping bag of claim 1 wherein the tabs comprise loops.

3. The sleeping bag of claim 1 wherein the tabs are attached to at least one of the top layer or the bottom layer.

4. The sleeping bag of claim 1 wherein the tabs are attached to reinforced areas of the sleeping bag.

5. The sleeping bag of claim 1 wherein areas around the first opening and the second opening are reinforced areas.

6. The sleeping bag of claim 1 the top layer and the bottom layer are fixedly attached on at least a first side, and further comprising a fastener to reversibly fasten the top layer and the bottom layer on a second side, and a flap to at least partially cover the fastener.

7. The sleeping bag of claim 6 wherein the fastener is a zipper.

8. The sleeping bag of claim 1 and further comprising at least one zipper to close at least one of the first opening or the second opening.

9. The sleeping bag of claim 1 and further comprising a first zipper to close the first opening and a second zipper to close the second opening, and wherein areas around the first opening and the second opening are reinforced areas.

10. The sleeping bag of claim 1 wherein substantially all of the top layer contains insulation and substantially all of the bottom layer contains insulation.

11. An elevated sleeping system, comprising:

a sleeping bag having a top layer, a bottom layer, a first opening on a head end, a second opening on a foot end, tabs attached near the head end and the foot end, a flexible flap inside the sleeping bag on the head end to at least partially block the first opening, a flexible flap inside the sleeping bag on the foot end to at least partially block the second opening, the top layer and the bottom layer being at least partially attached to each other; and a hammock comprising a bed and a pair of rings or loops on opposite ends of the bed, the bed being at least partially inside the sleeping bag, and the hammock extending at least partially from the first opening and at least partially from the second opening;

wherein the first and second openings being in the bottom layer and having sufficient width to accommodate at least part of the hammock.

12. The elevated sleeping system of claim 11 wherein the tabs comprise loops.

13. The elevated sleeping system of claim 11 wherein the tabs are attached to reinforced areas of the sleeping bag.

14. The elevated sleeping system of claim 11 wherein the bottom layer further comprises insulation extending substantially throughout the bottom layer, the insulation being below the first opening and the second opening.

15. The elevated sleeping system of claim 11 and further comprising a first zipper to close the first opening and a second zipper to close the second opening, and wherein areas around the first opening and the second opening are reinforced areas.

16. The elevated sleeping system of claim 11 and further comprising:

a fastener to reversibly fasten at least a part of the top layer to at least a part of the bottom layer; and a flap to at least partially cover the fastener.

17. An article of manufacture, comprising:

a sleeping bag having a top layer containing insulation, a bottom layer containing insulation, a fastener to reversibly fasten at least a part of the top layer to at least a part of the bottom layer, a flap to at least partially cover the fastener, a first opening on a head end and a second opening on a foot end, the insulation of the top layer being above the first and second openings, the insulation of the bottom layer being below the first and second openings, a flexible flap inside the sleeping bag on the head end to at least partially cover the first opening, a flexible flap inside the sleeping bag on the foot end to at least partially cover the second opening, the first and second openings being in the bottom layer, at least two chord loops attached to areas on or near the head end, at least two chord loops attached to areas on or near the foot end, the areas where the chord loops are attached being reinforced, a first zipper to close the first opening and a second zipper to close the second opening, and wherein areas around the first opening and the second opening are reinforced areas; and a hammock comprising a bed and a pair of support rings or loops on opposite ends of the bed, the bed being at least partially within the sleeping bag, at least part of the hammock extending from the first opening and at least part of the hammock extending from the second opening; and wherein the first opening and the second opening have sufficient width to accommodate at least part of the hammock.

18. The article of manufacture of claim 17 wherein substantially all of the top layer contains insulation and substantially all of the bottom layer contains insulation.

* * * * *